US008047935B2

(12) United States Patent
Sugaya

(10) Patent No.: US 8,047,935 B2
(45) Date of Patent: Nov. 1, 2011

(54) SPORTING PIPE

(75) Inventor: Eiji Sugaya, Sayama (JP)

(73) Assignee: Daiwa Seiko, Inc., Tokyo (JP)

( * ) Notice: Subject to any disclaimer, the term of this patent is extended or adjusted under 35 U.S.C. 154(b) by 0 days.

(21) Appl. No.: 12/461,065

(22) Filed: Jul. 30, 2009

(65) Prior Publication Data

US 2010/0029417 A1 Feb. 4, 2010

(30) Foreign Application Priority Data

Jul. 31, 2008 (JP) ..... P2008-198472
Jul. 31, 2008 (JP) ..... P2008-198473
Jul. 31, 2008 (JP) ..... P2008-198474

(51) Int. Cl.
*A63B 59/14* (2006.01)

(52) U.S. Cl. ..... 473/561

(58) Field of Classification Search ..... 473/560–563, 473/303, 549, 551, 513
See application file for complete search history.

(56) References Cited

U.S. PATENT DOCUMENTS

| | | | | |
|---|---|---|---|---|
| 5,333,857 | A | 8/1994 | Lallemand | |
| 5,863,269 | A * | 1/1999 | Filice | 473/562 |
| 5,865,696 | A * | 2/1999 | Calapp et al. | 473/561 |
| 6,939,257 | B2 * | 9/2005 | Tiitola | 473/561 |
| 2002/0094891 | A1 * | 7/2002 | Horwood et al. | 473/560 |
| 2003/0008734 | A1 * | 1/2003 | Tiitola | 473/560 |
| 2005/0187045 | A1 * | 8/2005 | Berghash | 473/560 |
| 2005/0215365 | A1 * | 9/2005 | Lussier et al. | 473/560 |
| 2007/0155548 | A1 * | 7/2007 | Goldsmith et al. | 473/562 |
| 2009/0233741 | A1 * | 9/2009 | Gans | 473/563 |

FOREIGN PATENT DOCUMENTS

| | | |
|---|---|---|
| JP | 3-234614 | 10/1991 |
| JP | 6-198010 | 7/1994 |

* cited by examiner

*Primary Examiner* — Mark Graham
(74) *Attorney, Agent, or Firm* — McGinn IP Law Group, PLLC

(57) ABSTRACT

A rectangular sporting pipe includes a shaft and at least two bulging portions formed on a surface portion of the shaft, the bulging portions extending in a longitudinal direction of the shaft and bulging outwardly.

18 Claims, 6 Drawing Sheets

SPORTING PIPE

BACKGROUND OF THE INVENTION

The present invention relates to a hollow rectangular sporting pipe having a rectangular cross-section, for sports, especially use in a shaft of an athletic stick used in a game, e.g., an ice hockey, a field hockey, or a cricket.

Hitherto, hollow rectangular sporting pipes of various forms have been known, each of which has a rectangular cross-section (see, e.g., JP-A-6-198010, JP-A-03-234614). Such rectangular sporting pipes are used in various industrial fields, and widely utilized in, e.g., shafts of athletic sticks to be used in games.

The above athletic stick has a shaft to be gripped and held by a user, and a blade for hitting a ball or a puck, which is mounted at a leading end of the shaft integrally therewith and detachably therefrom. It is known that the weight of the shaft of such an athletic stick can be reduced using, e.g., a composite material such as a fiber-reinforced plastic.

As disclosed in the above documents, the rotating-torque acting on the shaft at the ball hitting by the blade portion can be suppressed by cross-sectionally rectangularly shaping the shaft, as compared with the case of cross-sectionally circularly or elliptically shaping the shaft. However, in order to more improve the directionality of a hit ball and to perform fast ball-hitting (or take a fast shot), it is preferable that the athletic stick is configured to suppress the torque acting on the shaft thereof.

SUMMARY OF THE INVENTION

The invention is accomplished by focusing attention on the above problems. An object of the invention is to provide an athletic stick capable of suppressing, when ball-hitting by a blade is performed, the rotation of a shaft portion thereof.

To achieve the above object, the present invention provides the following arrangements:

(1) A rectangular sporting pipe comprising:
- a shaft; and
- at least two bulging portions formed on a surface portion of the shaft, the bulging portions extending in a longitudinal direction of the shaft and bulging outwardly.

(2) The rectangular sporting pipe according to (1), wherein
- the shaft has a polygonal shape in a cross section, and
- the bulging portions are formed on corners of the shaft, respectively.

(3) The rectangular sporting pipe according to (1), wherein
- the shaft is constructed by winding a prepreg sheet which is formed by impregnating a reinforcing fiber with a resin, and
- the bulging portions and the shaft are formed integrally by the prepreg sheet.

(4) The rectangular sporting pipe according to (3), wherein
- the reinforcing fiber of the prepreg sheet is arranged along a circumferential direction of the shaft to form a hollow rectangular shape having four corners and four side-surface portions between two of the four corners,
- the bulging portions are formed on the four corners, respectively,
- the reinforcing fiber at the bulging portions is formed like a circular arc shaped convex and continue to the reinforcing fiber at the four side-surface portions.

(5) The rectangular sporting pipe according to (4), wherein
- the prepreg sheet is formed by laminating reinforcing fiber layers each including the reinforcing fiber in the circumferential direction, and

- a radius of curvature of the circular arc of the reinforcing fibers gradually increases as the outside of the reinforcing fiber layer.

(6) The rectangular sporting pipe according to (3), wherein
- the shaft has a hollow rectangular shape having four corners and four side-surface portions between two of the four corners,
- the bulging portions are formed on the four corners, respectively,
- a resin content rate of the prepreg disposed at each of the bulging portions is higher than that of the prepreg disposed in each of the side-surface portions.

(7) The rectangular sporting pipe according to (1), wherein
- a blade is attachable to a leading end of the shaft to form an athletic stick.

In the rectangular sporting pipe of the above configuration, at least two bulging portions which extend in the direction of the length of the shaft and which bulge outwardly are formed on the surface portion of the shaft. Thus, when the shaft is gripped or held by a user, the degree of the engagement in the direction of rotation of the shaft with the user's palms and finger balls is enhanced by the bulging portions. Consequently, the rotation of the shaft is effectively suppressed. Accordingly, the invention can achieve ball-hitting so that a hit ball is high in speed and good in directionality.

In the rectangular sporting pipe of the above configuration, the circumferentially-oriented reinforcing fiber of each of the four corner portions is formed like a circular arc shaped convex towards the outside in the cross-section and that the circumferentially-oriented reinforcing fiber of each of the four corner portions communicates to the circumferentially-oriented reinforcing fiber of each of the two adjacent side-surface portions in the cross-section. That is, the fibers of each of the corner portions do not sharply bend. Thus, the stiffness of each of the corner portions is high. Consequently, the rectangular sporting pipe according to the invention has resistance against crushing and twisting. More specifically, with the above configuration, the higher the rate of increasing the radius of curvature of the circular arc of the circumferentially-oriented reinforcing fiber of each of the corner portions towards the outermost fiber layer in the cross-section is, and the larger the amount by which the thickness of the fiber layer of each of the corner portions is larger than that of the fiber layer of each of the adjacent side-surface portions connected thereto in the cross-section is, the stiffness of each of the corner portions is more increased. Consequently, the pipe can effectively be prevented from starting to be crushed and twisted at the corner portions.

In the above configuration, the term "outside" designates a side away from the central axis in the axial direction of the shaft. The term "circumferentially-oriented reinforcing fibers" represents reinforcing fibers arranged together in a direction of an angle in a range between (90°+45°) and (90°−45°) with respect to the long axis of the shaft. Apparently, due to such a circumferentially-oriented fiber (or fiber layer) interwoven into the pipe's material to be reinforced, the pipe can be prevented from being crushed and buckled. The term "fiber" in the above configuration is a broad concept including a fabric into which circumferentially-oriented fibers and the shaft's longitudinally-oriented reinforcing fibers (or skew reinforcing fibers) are woven, in addition to the fiber base material formed of fibers arranged together in a circumferential direction. In the above configuration, the term "circular arc" represents a contour which is a smoothly curved as a whole (without including a sharply bent part) even though a straight line is partly included in the contour in the cross-section.

In the rectangular sporting pipe of the above configuration, the resin content rate of the fiber layers of each of the corner portions is higher than that of the fiber layers of each of the side-surface portions. Thus, especially, the impact resistance (impact absorption ability) of the corner portions is increased by the resin. That is, the impact resistance of each of the corner portions in the rectangular cross-section can be enhanced.

According to the invention, an athletic stick is obtained, which is configured such that when a ball is hit by a blade of an athletic stick, the rotation of a shaft portion thereof can effectively be suppressed, and a hit ball which is high in speed and good in directionality can be caused.

The invention can provide a rectangular sporting pipe which is a cross-sectionally rectangularly-shaped hollow one and can enhance the strength of each corner portion of a rectangular cross-section and which has resistance to crushing and twisting.

According to the invention, a rectangular sporting pipe capable of improving the impact resistance of each corner portion in a rectangular cross-section thereof can be provided.

DETAILED DESCRIPTION OF THE PREFERRED EMBODIMENTS

Hereinafter, an embodiment of a rectangular sporting pipe according to the invention is more specifically described with reference to the accompanying drawings.

Figure 1:
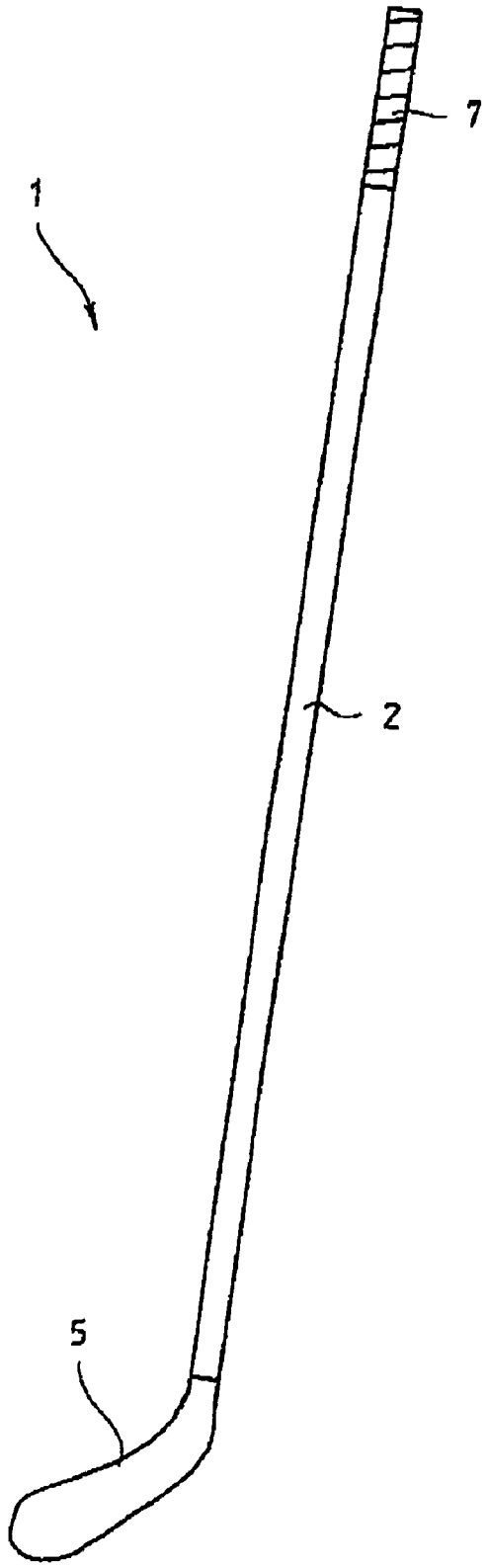
FIG. 1 is a view illustrating the entire configuration of an athletic stick having a rectangular sporting pipe according to the invention.

FIG. 1 is a view illustrating the entire configuration of an athletic stick 1 having a shaft 2 as an example of the rectangular sporting pipe according to the invention.

The athletic stick 1 according to the present embodiment is configured to include a shaft 2 and a blade 5 attached to a leading end of the shaft 2 and to hit a ball or a puck. The shaft 2 is constructed by winding around a core metal what is called a prepreg sheet that is formed by an impregnating reinforcing fiber (e.g., carbon fiber, glass fiber, and aramid fiber) with a matrix resin such as an epoxy resin, a polyester resin, and a phenol resin. More specifically, the shaft 2 according to the present embodiment is constructed as a hollow rectangular sporting pipe of rectangular shape in a cross-section by laminating at least circumferentially-oriented reinforcing fibers arranged in a circumferential direction (more realistically, a woven-cloth-like material woven with a circumferentially reinforcing fiber and an axially reinforcing fiber (or skew reinforcing fiber)). The shaft 2 includes corner portions 2A provided at four corners of a transverse-cross-section and four side-surface portions 2*a* each of which connects the adjacent two of the corner portions (see FIGS. 2 and 3). The inside of the shaft 2 is filled with foam or the like so as to be able to absorb vibrations.

Figure 3:
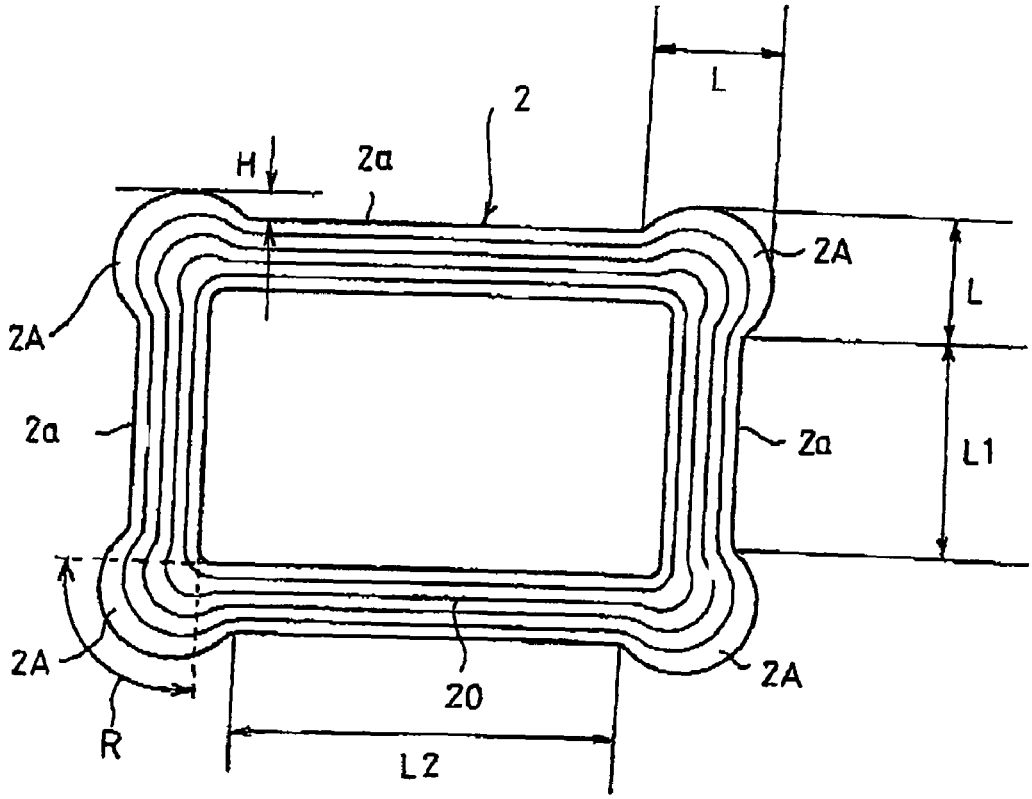
FIG. 3 is a transversally-cross-sectional view illustrating the shaft.

The term "corner portions" 2A designate regions respectively provided corresponding to the four corners of a transverse-cross-section of the rectangular sporting pipe (shaft 2), each of which includes at least a part constituted by extension portions of adjacent inner surfaces thereof within an angular range R (whose boundaries are respectively indicated by dashed lines) at the side of an outer circumferential surface thereof in the transverse-cross-section, as illustrated in FIG. 3.

Gripping tape 7 is wound around the base end portion of the shaft 2. Usually, the shaft 2 is cut according to a user's body height and position taken in a game. The gripping tape 7 is wound therearound to hide a cut part. The gripping tape 7 can be wound directly around the outer circumferential surface of the shaft 2. Alternatively, the gripping tape 7 can be wound around the base end portion of the shaft 2, to which another member is attached in consideration of grippability.

The shape and the material of the blade 5 are selected according to the purpose thereof. The blade 5 is attached to the leading end of the shaft 2. In this case, the blade 5 can be integral with the shaft 2. Alternatively, the blade 5 can be configured to be replaceable with another one.

Figure 2:
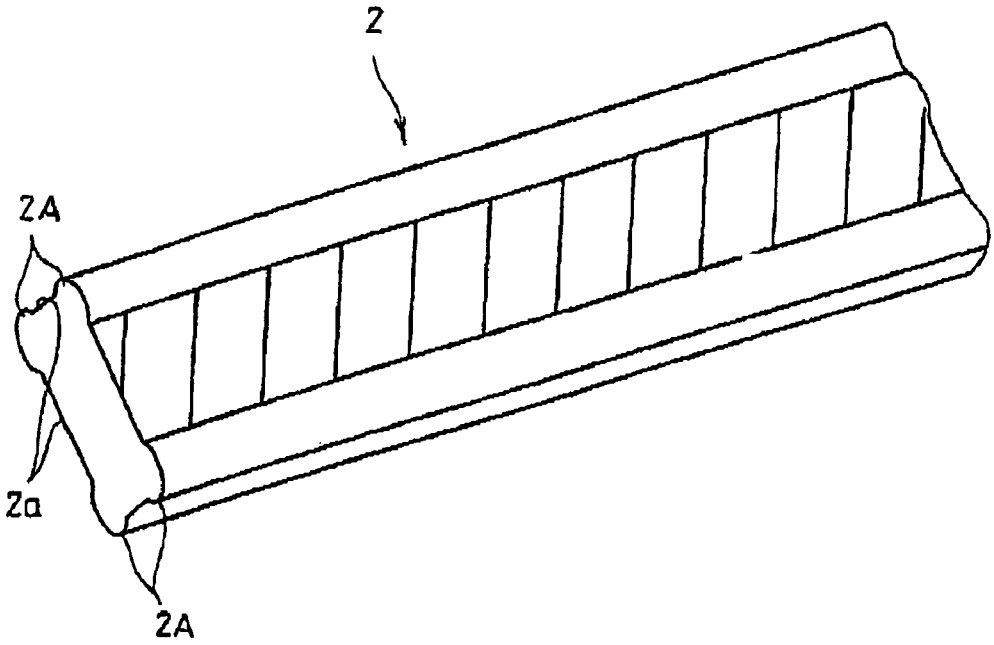
FIG. 2 is a perspective view illustrating a longitudinally-cross-sectional shape of a shaft illustrated in FIG. 1.
Figure 4:
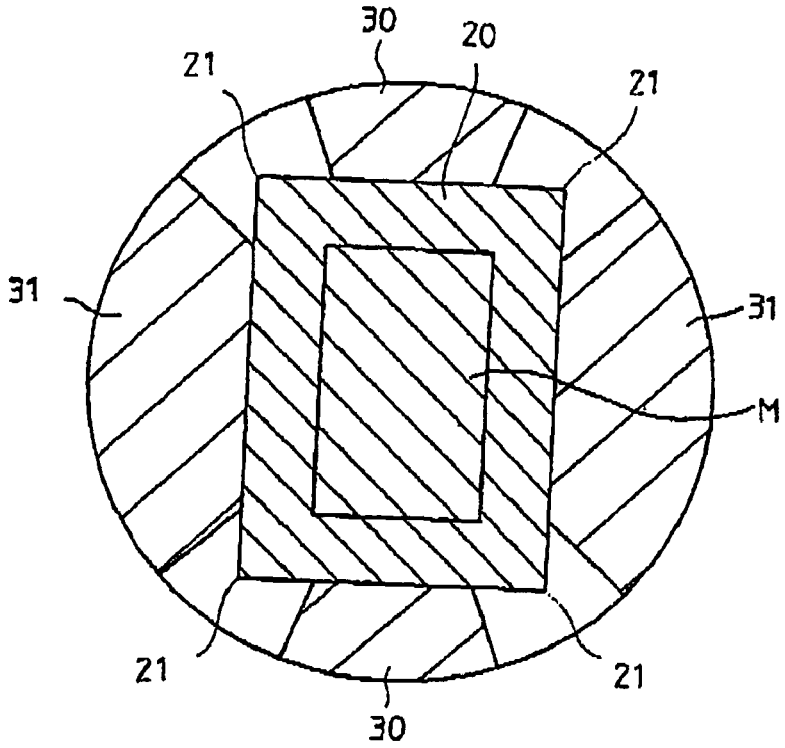
FIG. 4 is a transversally-cross-sectional view schematically illustrating a manufacturing method for the shaft.
Figure 5:
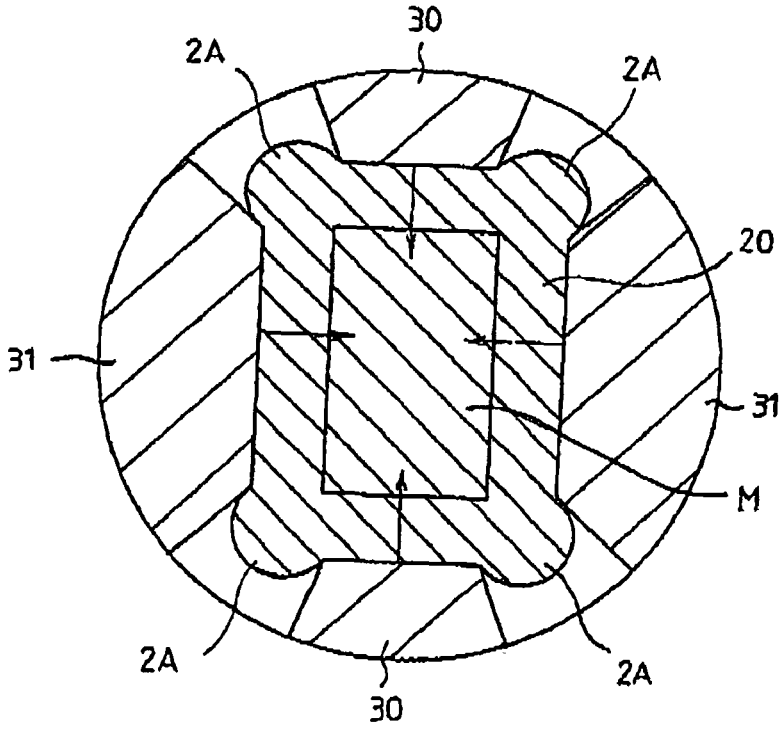
FIG. 5 is a transversally-cross-sectional view schematically illustrating a manufacturing method for the shaft in a state in which bulging portions are formed therein.
Figure 6:
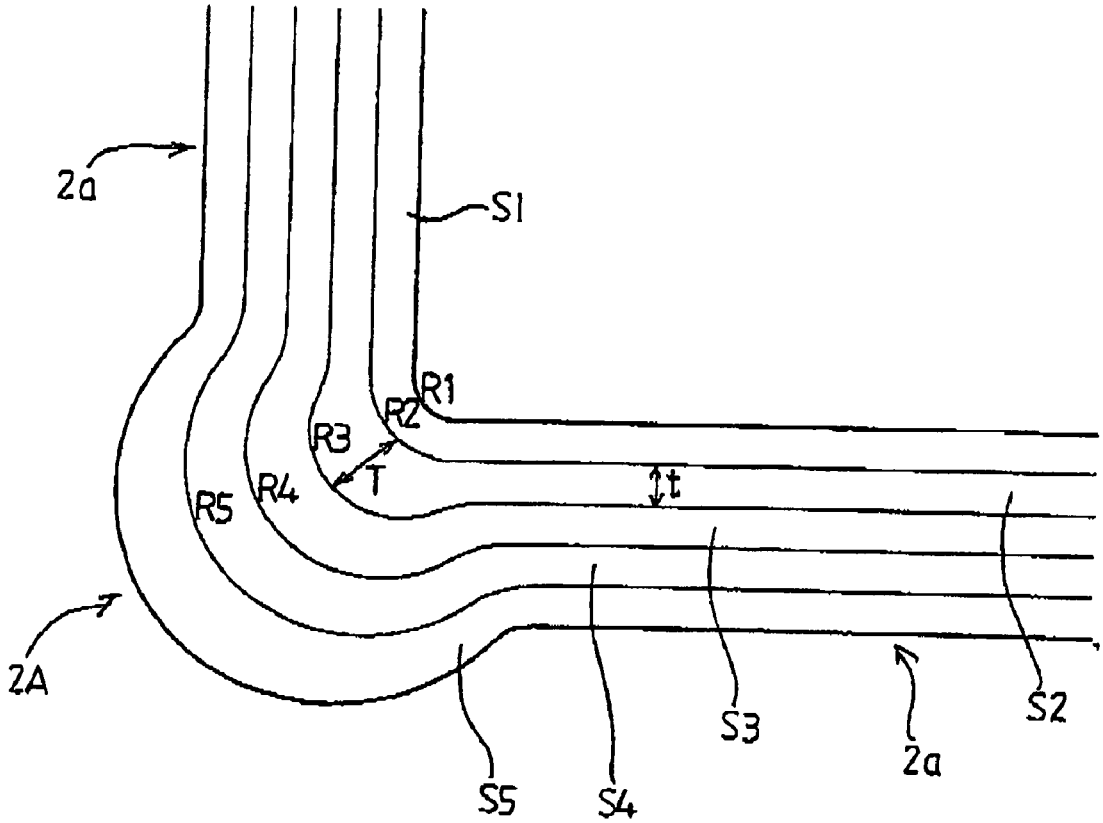
FIG. 6 is an enlarged transverse-cross-sectional view illustrating a corner portion of the shaft.

FIGS. 2 to 7 illustrate the configurations of the shaft 2 illustrated in FIG. 1. FIG. 2 is a perspective view illustrating a cross-sectional shape of the shaft 2. FIG. 3 is a cross-sectional view of the shaft 2. FIG. 4 is a cross-sectional view schematically illustrating an example of a method for manufacturing the shaft 2. FIG. 5 is a cross-sectional view schematically illustrating an example of a method for manufacturing the shaft 2 in a state in which the corner portions 2A are formed as bulging portions. FIG. 6 is an enlarged cross-sectional view of the corner portion 2A.

As described above, according to the present embodiment, the shaft 2 is constructed as a hollow rectangular sporting pipe of a rectangular shape in a cross-section by laminating at least prepreg sheets formed as a circumferentially-oriented reinforcing fiber arranged together in a circumferential direction (more realistically, a woven-cloth-like material woven with a circumferentially reinforcing fiber and an axially reinforcing fibers (or skew reinforcing fiber)) impregnated with a resin. More specifically, as clearly illustrated in FIG. 6, in each of fiber layers S1, S2, S3, S4, and S5 (or a part of these fiber layers) constituting the shaft 2, the circumferentially-oriented fiber of each of the corner portions 2A is formed like a circular arc shaped convex towards the outside in the transverse-cross-section. The circumferentially-oriented fiber at each of the corner portions 2A continue to those at the adjacent side-surface portions 2*a*. Consequently, according to the present embodiment, each of the corner portions 2A of the shaft 2 is formed as a bulging portion that extends in the longitudinal direction of the shaft thereof and that bulges towards the outside. The radius of curvature of the circular arc of the circumferentially-oriented fibers at each of the corner portions 2A gradually increases as the outside of the fiber layer. More particularly, in the transverse-cross-section, the radius of curvature R2 of the circular arc of the second fiber layer S2, which is the next innermost fiber layer, is larger than that R1 of the circular arc of the first fiber layer S1 that is the innermost fiber layer. This relationship in the radius of curvature is similarly applied to the outer fiber layers S3 to S5. That is, the following relationship in the radius of curvature among the fiber layers holds: the radius of curvature R2 of the circular arc of the second layer S2 of each of the corner portions 2A<the radius of curvature R3 of the circular arc of the third layer S3 of each of the corner portions 2A<the radius of curvature R4 of the circular arc of the fourth layer S4 of each of the corner portions 2A<the radius of curvature R5 of the circular arc of the fifth layer S5 of each of the corner portions 2A. In addition, according to the present embodiment, the thickness T of each of the fiber layers S1 to S5 of each corner layer 2A is larger than that t of each of the fiber layers S1 to S5 of the side-surface portion 2*a*.

Further, as illustrated in FIG. 6, the resin content rate of resin 50 of each of the fiber layers S1 to S5 of the corner portions 2A is set to be higher than that of the resin 50 of each of the fiber layers S1 to S5 of the side-surface portions 2*a*. Consequently, according to the present embodiment, the cured portions 2A of the shaft 2 are formed as bulging portions that extend in the longitudinal direction of the shaft thereof and bulges outwardly, by way of example. The resin content rate of the resin 50 of each of the fiber layers S1 to S5 of the corner portions 2A ranges from 45% to 60%. The resin content rate of the resin 50 of each of the fiber layers S1 to S5 of the side-surface portions 2*a* ranges from 30% to 45%. Preferably, in comparison, the resin content rate of the resin 50 of each of the fiber layers S1 to S5 of the corner portions 2A is higher than that of the resin 50 of each of each of the fiber layers S1 to S5 of the corner portions 2A is higher than that of the resin 50 of each of the fiber layers S1 to S5 of the side-surface portions 2*a* by 30% to 50%.

Each corner portion 2A serving as a bulging portion can be formed to outwardly bulge towards the side-surface portion 2*a* of the shaft 2. Preferably, the surface of each corner portion 2A is formed like a circular arc in the transverse-cross-section such that the shaft 2 is comfortable to grip. In a case where the height H of the corner portion 2A with respect to the side-surface portion 2*a* in the transverse-cross-section is too high, a user of the shaft 2 is liable to feel uncomfortable when gripping the shaft 2. On the other hand, in a case where the height H in the transverse-cross-section is too low, the effects of suppressing the rotation of the shaft 2 cannot be sufficient. Thus, preferably, the height H in the transverse-cross-section ranges from 0.3 mm to 1.2 mm. More preferably, the height H in the transverse-cross-section ranges from 0.4 to 0.8 mm. In addition, it preferable that the length L of each corner portion 2A formed like a bulging portion is set so as to range from 6 mm to 7 mm, that the length L1 of the side-surface portion 2*a* in the transverse-cross-section is set so as to range from 7 mm to 8 mm, and that the length L2 of another side-surface portion 2*a* in the transverse-cross-section is set so as to range from 10 mm to 16 mm. The setting of the lengths L, L1, and L2 at such values results in improvement of a user's feeling of holding the shaft 2 and in facilitation of engagement of a user's palms and finger balls with each corner portion 2A formed like a bulging portion. Consequently, the rotation of the shaft 2 can be suppressed.

The shaft 2 of the above configuration can be constructed by winding, e.g., a prepreg sheet 20 around the core metal (mandrel) M of a rectangular shape in a cross-section from a leading end to the base end thereof. In this case, as described above, the prepreg sheet 20 is constructed by impregnating the reinforcing fiber woven into a cloth with a synthetic resin. The prepreg sheet 20 is wound around the core metal M a predetermined number of times.

The prepreg sheet can include a material (one-way prepreg sheet) which contains not only a circumferentially-oriented reinforcing fiber but the longitudinally-oriented reinforcing fiber (or skew reinforcing fiber). In this case, preferably, one-way prepreg sheets are superposed and combined such that the directions, in which the reinforcing fiber is arranged together, intersect with one another to prevent the shaft from being broken and cracked. Alternatively, a reinforcing prepreg sheet can be wound around the core metal such that the core metal is partly reinforced in the longitudinal direction of the shaft. Such a reinforcing prepreg can be stuck to the prepreg sheet 20.

A leading edge of the prepreg sheet 20 of the above configuration is held to the core metal M along the longitudinal direction of the shaft and ironed thereonto. Then, the prepreg sheet 20 was wound around the core metal M while rolled thereon. Upon completion of winding the prepreg sheet 20, the prepreg sheet 20 is fixated by winding a fixing tape (not shown) therearound.

The core metal M taped after the prepreg sheet 20 is wound therearound as described above is then heated while pressing-molds 30 and 31 each having a predetermined shape press the core metal M such that the vertex parts (corner portions) 21 of the prepreg sheet 20 in the transverse-cross-section are exposed, as illustrated in FIG. 4. At that time, the pressing molds 30 and 31 press the cross-sectionally rectangular surface portions of the core metal M with substantially uniform pressure applied towards the center of the core metal M in directions orthogonal to one another (see arrows illustrated in FIG. 5).

Consequently, when the synthetic resin of the prepreg sheet 20 is thermally cured by the above heating process, resin flows into each of the vertex parts in the transverse-cross-section due to pressing forces by the pressing molds 30 and 31. Then, as illustrated in FIG. 5, the resin bulges outwardly and substantially uniformly (each vertex part 21 is put into a resin rich state and bulges outwardly). Finally, each corner portion 2A formed like a bulging portion having a surface of a circular-arc-shape in a cross-section, is formed integrally with the shaft 2. Subsequently, the shaft 2 illustrated in FIG. 1 is formed through a fixing-tape peeling step and a core removal step. The appearance of the shaft 2 can be improved by, e.g., coating or attaching a decorative film to the surface of the shaft 2.

Figure 7:
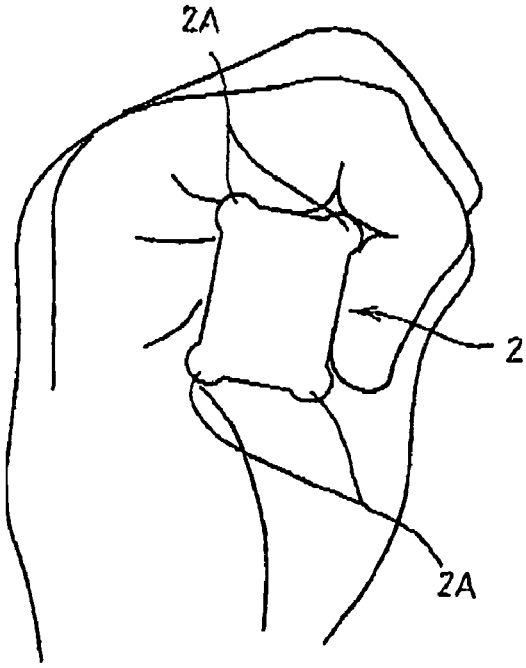
FIG. 7 is a view illustrating the gripped and held shaft, which is taken from the side of a grip end of the shaft.
Figure 8:
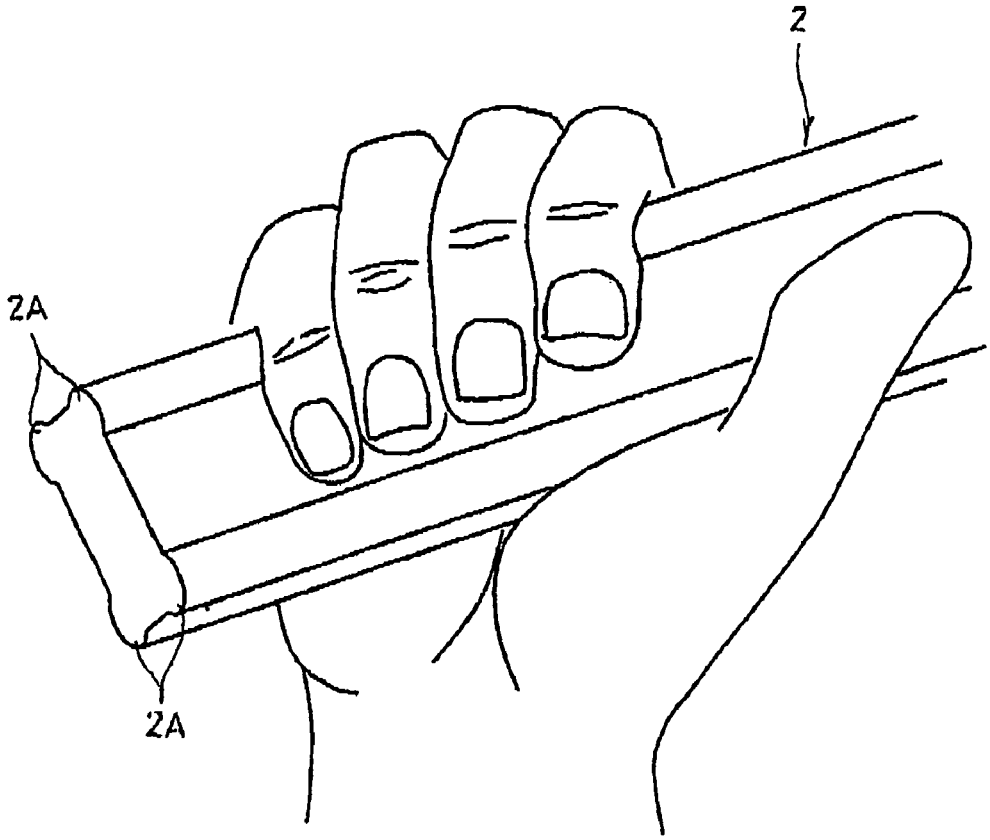
FIG. 8 is a perspective view illustrating a state in which the shaft is gripped and held.

In the shaft (or rectangular sporting pipe) 2 of the athletic stick 1 of the above configuration, the circumferentially-oriented fiber of each of the corner portions 2A is formed like a circular arc shaped convex towards the outside in the transverse-cross-section and continues to the circumferentially-oriented fiber of each of the adjacent side-surface portions 2*a*. That is, the fiber of each of the corner portions does not sharply bend. Thus, the stiffness of each of the corner portions is high. Consequently, the rectangular sporting pipe according to the invention has resistance against crushing and twisting. In addition, as illustrated in FIGS. 7 and 8, even in a case where the shaft 2 is going to turn when a ball or a puck is hit by gripping and holding the shaft 2, a user's finger balls and palms easily engage with the corner portions 2A formed like bulging portions. Thus, the rotation of the shaft 2 can effectively be suppressed. Consequently, when a ball or a puck is strongly hit, the shaft 2 does not wobble. Accordingly, the present embodiment can achieve ball-hitting so that a hit ball which is high in speed and good in directionality. More particularly, according to the above embodiment, the vertex parts of the cross-sectionally rectangular portions are made to bulge. Thus, the grippability and the holdability of the shaft 2 can be improved. In addition, the rotation of the shaft 2 can more effectively be suppressed.

Further, according to the shaft (rectangular sporting pipe) 2 of the athletic stick 1 of the above configuration, the impact resistance of each of the corner portions 2A formed like bulging portions is enhanced due to increase in the resin content rate thereof. Thus, the shaft 2 becomes break-resistant. In addition, as illustrated in FIGS. 7 and 8, even in a case where the shaft 2 is going to turn when a ball or a puck is hit by gripping and holding the shaft 2, a user's finger balls and palms easily engage with the corner portions 2A formed like bulging portions. Thus, the rotation of the shaft 2 can effectively be suppressed.

According to the above embodiment, the corner portions 2A formed like the bulging portions 2A and the shaft 2 are integrally formed using the prepreg sheet 20. Thus, the adhesiveness between each corner portion 2A and a shaft body is high. In addition, the shaft 2 can easily be manufactured. The cost of the shaft 2 can be reduced.

In the foregoing description, an embodiment of the invention has been described. However, the invention is not limited to the above embodiment. Various modification of the embodiment can be made.

Figure 9:
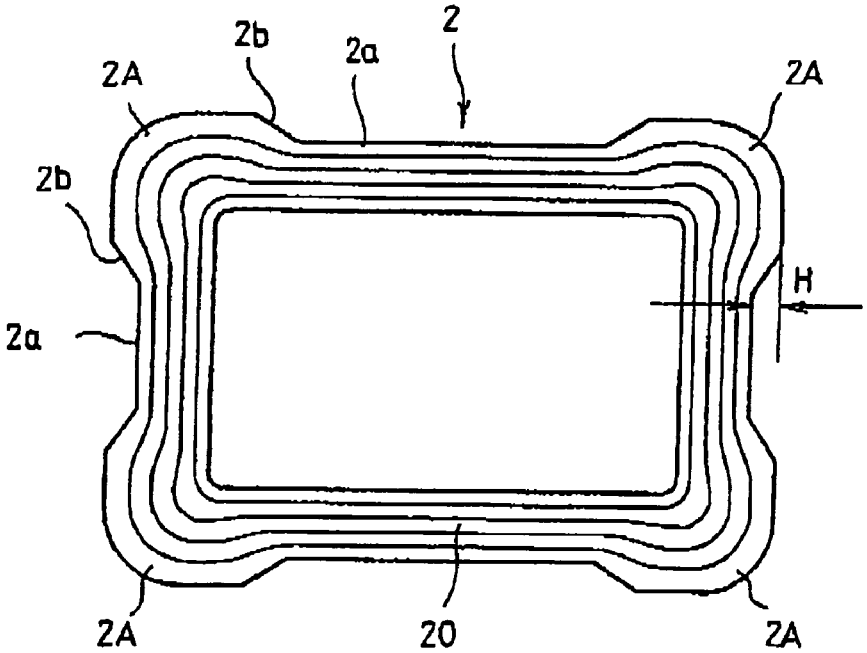
FIG. 9 is a transversally-cross-sectional view illustrating a first modification of the shaft.

The above corner portions 2A protrude outwardly from a surface part of the shaft 2. However, it is not always necessary that the entire corner portion 2A is a circular arc as a whole. The corner portion 2A can be configured to partly have a straight line part 2*b*, as illustrated in, e.g., FIG. 9. Thus, the shape of the corner portion 2A can appropriately be changed according to the shape of the pressing mold used in the heating step.

The bulging portions can be constructed by attaching, after the shaft 2 is formed by the aforementioned procedure, a separate body thereto. In this case, an example of the separate body to be attached thereto to construct the bulging portion is a thick tape which is attached to each of the corner portions so that the bulging portions can be constructed. Another example of the separate body is a cross-sectionally L-shaped resin cover which is attached along the longitudinal direction of the shaft of each of the corner portions so that the bulging portions can be constructed.

Figure 10:
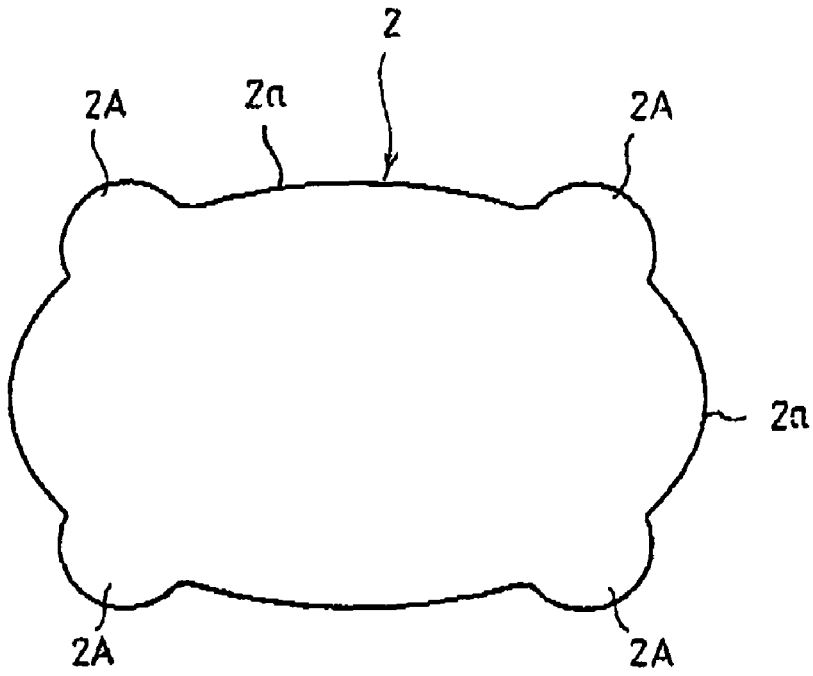
FIG. 10 is a transversally-cross-sectional view illustrating a second modification of the shaft.
Figure 11:
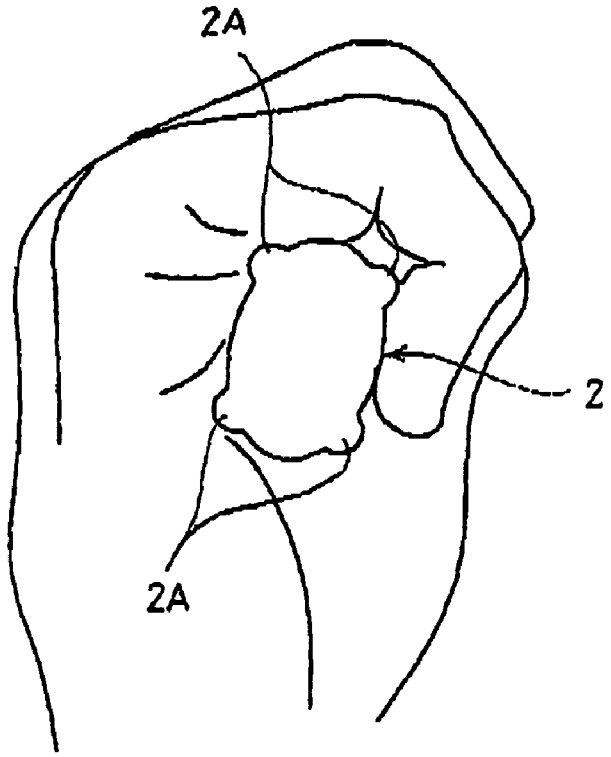
FIG. 11 is a perspective view illustrating a state in which the second modification of the shaft is gripped and held.

The cross-sectional shape of the shaft 2 can be a pentagonal or higher-order polygonal shape. Alternatively, as illustrated in FIGS. 10 and 11, the shaft 2 can be cross-sectionally circularly-shaped or elliptically-shaped. In order to effectively prevent the rotation of the shaft and the deterioration of the feeling of gripping the shaft, it is sufficient that the number of the corner portions 2A formed like the bulging portion, which are provided in the surface part of the shaft 2, is at least 2. The bulging portion can be provided at a part other than the vertex part in the polygonal cross-section. Alternatively, the bulging portion can be provided only in a region mainly gripped and held in the longitudinal direction of the shaft.

Although the above embodiment employs the prepreg sheets as the material of the shaft, the construction material and the method of formation of the shaft can appropriately be modified. For example, a shaft having a shape similar to that of the shaft according to the present application can be obtained by a pultrusion method.

In the above embodiment, the prepreg sheet constituting the shaft 2 can appropriately be modified in, e.g., the direction in which the reinforcing fiber is arranged together, the amount of the synthetic resin impregnated into the reinforcing fiber, the thickness of the prepreg sheet, and the number of windings thereof. Although the shaft according to the above embodiment is formed in a structure of laminated layers of the fibers, the shaft can be constituted by a single layer thereof.

The hollow rectangular sporting pipe according to the above embodiment can be used not only for an ice hockey, a field hockey, and a cricket, but also for a frame of a bicycle including a wheelchair, a fishing rod, a shaft of a golf club (driver, iron, and putter), an oar for a boat, a climbing stick, etc.

What is claimed is:

1. A rectangular sporting pipe, comprising:

a shaft; and at least two bulging portions formed on a surface portion of a corner of the shaft, the bulging portions extending in a longitudinal direction of the shaft and bulging outwardly, wherein the shaft comprises a plurality of prepreg sheets wound around entirely, said prepreg sheets being formed by impregnating a reinforcing fiber with a resin, wherein the bulging portions and a side surface of the shaft are formed integrally by the plurality of prepreg sheets, wherein each of the bulging portions projects outwardly from the side surface of the shaft, wherein a part of the bulging portions adjacent to the side surface extends outwardly at an angle with a plane of the side surface of the shaft, and wherein an angle between an outer prepreg at a border of the side surface and a corresponding one of the bulging portions is smaller than that of an inner prepreg.

2. The rectangular sporting pipe according to claim 1, wherein the shaft has a polygonal hollow shape in a cross section, and wherein the bulging portions are formed on corners of the shaft, respectively.

3. The rectangular sporting pipe according to claim 1, wherein the reinforcing fiber of the prepreg sheets are arranged along a circumferential direction of the shaft to form a hollow rectangular shape having four corners and four side-surface portions between two of the four corners, wherein the bulging portions are formed on the four corners, respectively, and wherein a reinforcing fiber at said each of the bulging portions has a circular arc shaped convex and continues to each of the four side-surface portions.

4. The rectangular sporting pipe according to claim 3, wherein the prepreg sheets are formed by laminating reinforcing fiber layers each including the reinforcing fiber in the circumferential direction, and wherein a radius of curvature of circular arc of the reinforcing fibers increases from an inside toward an outside of the reinforcing fiber layers.

5. The rectangular sporting pipe according to claim 1, wherein the shaft has a hollow rectangular shape having four corners and four side-surface portions between two of the four corners, wherein the bulging portions are formed on the four corners, respectively, and wherein a resin content rate of a prepreg disposed at said each of the bulging portions is higher than that of a prepreg disposed in each of the side-surface portions.

6. The rectangular sporting pipe according to claim 1, wherein a blade is attachable to a leading end of the shaft to form an athletic stick.

7. The rectangular sporting pipe according to claim 1, wherein the plurality of prepreg sheets forms an entire periphery of the pipe.

8. The rectangular sporting pipe according to claim 1, wherein, in said bulging portions, a radius of curvature of circular arc of each of said prepreg sheets increases in a circumference direction from an inside toward an outside of the shaft.

9. The rectangular sporting pipe according to claim 1, wherein each of said prepreg sheets comprises a same material as that of other ones of said prepreg sheets.

10. The rectangular sporting pipe according to claim 1, wherein a thickness of each of said prepreg sheets at said each of the bulging portions is greater than a thickness of said each of said prepreg sheets at a side-surface portion of said each of said prepreg sheets.

11. The rectangular sporting pipe according to claim 2, wherein an inside of the shaft is filled with a foam.

12. The rectangular sporting pipe according to claim 1, wherein a height of the bulging portions with respect to the side surface of the shaft is within a range from 0.3 mm to 1.2 mm.

13. The rectangular sporting pipe according to claim 1, wherein, in said bulging portions, in a circumference direction from an inside toward an outside of the shaft, a radius of curvature of an arc of one of said prepreg sheets increases from a radius of curvature of an arc of an adjacent one of said prepreg sheets.

14. A rectangular sporting pipe, comprising:

a shaft; and at least two bulging portions formed on a surface portion of a corner of the shaft, the bulging portions extending in a longitudinal direction of the shaft and bulging outwardly, wherein the shaft comprises a plurality of prepreg sheets wound around entirely, wherein the bulging portions and a side surface of the shaft are formed integrally by the plurality of prepreg sheets, and wherein, in said bulging portions, in a circumference direction from an inside toward an outside of the shaft, a radius of curvature of circular arc of one of said prepreg sheets increases from a radius of curvature of circular arc of an adjacent one of said prepreg sheets.

15. The rectangular sporting pipe according to claim 14, wherein, in said bulging portions, in the circumference direction from the inside toward the outside of the shaft, a radius of curvature of circular arc of each of said prepreg sheets increases from a radius of curvature of circular arc of others of said prepreg sheets that are placed closer to the inside of the shaft with respect to said each of said prepreg sheets.

16. The rectangular sporting pipe according to claim 14, wherein, in said bulging portions, in the circumference direction from the inside toward the outside of the shaft, a radius of curvature of circular arc of each of said prepreg sheets increases from a radius of curvature of circular arc of an adjacent prepreg sheet to said each of said prepreg sheets.

17. The rectangular sporting pipe according to claim 14, wherein, in said bulging portions and in said prepreg sheets, a radius of curvature of circular arc of a prepreg sheet is greater than a radius of curvature of circular arc of an adjacent prepreg sheet that is placed closer to the inside of the shaft with respect to the prepreg sheet, and the radius of curvature of circular arc of the prepreg sheet is less than a radius of curvature of circular arc of another adjacent prepreg sheet that is placed closer to the outside of the shaft with respect to the prepreg sheet.

18. The rectangular sporting pipe according to claim 14, wherein an angle is defined in an intersection of each of the bulging portions with one of the plurality of prepreg sheets in the side surface, said angle decreasing from said inside toward said outside of the shaft.

* * * * *